United States Patent [19]

Tanaka

[11] Patent Number: 4,933,982

[45] Date of Patent: Jun. 12, 1990

[54] BASS REFLEX TYPE SPEAKER SYSTEM DUCT HAVING MULTIPLE SOUND PATHS

[75] Inventor: Toshihiko Tanaka, Saitama, Japan

[73] Assignee: Pioneer Electronic Corporation, Tokyo, Japan

[21] Appl. No.: 280,903

[22] Filed: Dec. 7, 1988

[30] Foreign Application Priority Data

Dec. 14, 1987 [JP] Japan ..... 62-316980

[51] Int. Cl.[5] ..... H04R 1/28

[52] U.S. Cl. ..... 381/154; 181/156

[58] Field of Search ..... 381/154, 153, 158, 159, 381/87–90; 181/156

[56] References Cited

U.S. PATENT DOCUMENTS 2,880,817 4/1959 Burns et al. ..... 181/156

*Primary Examiner*—Jin F. Ng

*Assistant Examiner*—M. Nelson McGeary, III

*Attorney, Agent, or Firm*—Sughrue, Mion, Zinn, Macpeak & Seas

[57] ABSTRACT

A bass reflex type speaker system has a duct for transmitting sound waves. The duct is formed with a plurality of sound paths, and each of the sound paths has a unique length such that respective differences in the lengths of the sound paths cause destructive interference at particular frequencies. The interference occurs at a wavelength or wavelengths corresponding to the particular frequency or frequencies at which a local relative peak in sound level occurs due to leaking sound.

5 Claims, 3 Drawing Sheets

BASS REFLEX TYPE SPEAKER SYSTEM DUCT HAVING MULTIPLE SOUND PATHS

BACKGROUND OF THE INVENTION

The present invention relates to a bass reflex type speaker system. More particularly, the invention relates to a bass reflex type speaker system in which the sound reproduction level at a mid frequency range is improved.

FIG. 1 shows a fragmentary cross sectional view of a well known prior art bass reflex type speaker system. In FIG. 1, a duct 2 is mounted on a baffle plate 1 of a cabinet 3 to permit the inside of the cabinet 3 to communicate with the outside thereof. The duct 2 also turns the back pressure of a diaphragm to direct it to the outside of the cabinet 3. A simple circuit hollow cylinder has been used as the duct 2 for the bass reflex type speaker system.

With a bass reflex type speaker system such as that described above, there has been a problem that sound in the mid frequency range leaks from an aperture of the duct 2 to cause an extreme peak (shown in FIG. 2) in the mid frequency response. FIG. 3, which is a frequency characteristic diagram of sound level at a duct aperture of a duct according to the prior art, provides a further view of a peak in sound level at frequency $f_p$. Thus, articulateness in sound quality of the entire sound is lost.

SUMMARY OF THE INVENTION

The present invention has been designed to prevent leakage of mid frequency sound from the duct to thereby improve the quality of sound emanating from the speaker.

To achieve the aforementioned purpose, a duct according to the invention is provided at an intermediate portion thereof with a plurality of sound routes of different lengths formed therein.

DETAILED DESCRIPTION OF THE PREFERRED EMBODIMENT

Figure 4:
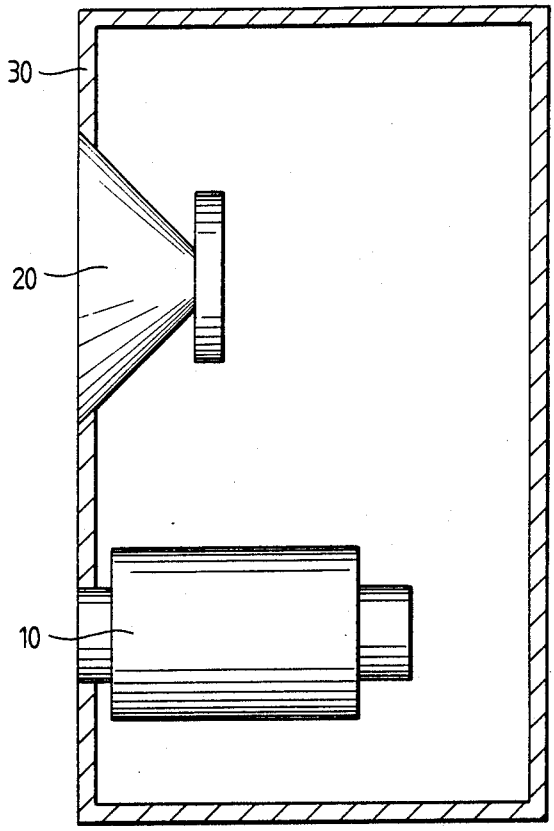
FIG. 4 is a sectional view of a bass reflex type speaker system according to the present invention.

An embodiment of the present invention will now be described with reference to FIG. 4 through FIG. 8. FIG. 4 is a sectional view of a bass reflex type speaker system according to the present invention. In FIG. 4, a duct 10 and a speaker 20 are mounted on a cabinet 30. The duct 10 is arranged in such a way that a plurality of sound paths 12, 13, 14... (FIGS. 5 and 7) are formed at an intermediate portion of an open ended, circular hollow cylindrical duct body 11. An entrance portion n of each sound path communicates with an axial sound path 11A. The lengths $l_{12}, l_{13}, l_{14}, \ldots$ of the respective sound paths 12, 13, 14, . . . are each different.

Figure 5:
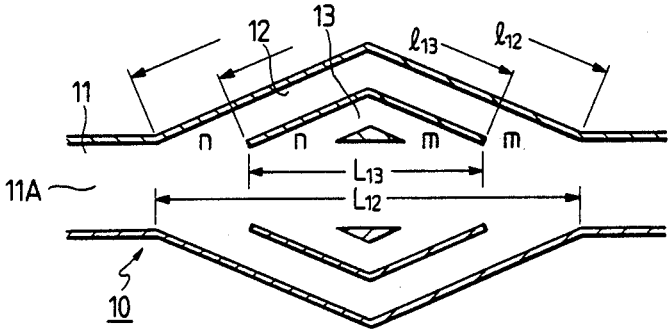
FIG. 5 is a diagram illustrating a construction of a duct of the bass reflex type speaker system according to the present invention.
Figure 6:
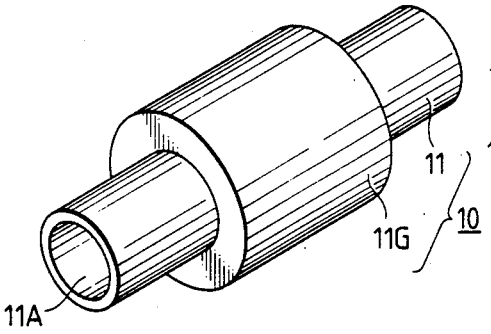
FIG. 6 is a perspective view of the duct according to the present invention.

With reference to FIG. 5, length $L_i$ represents the lengths $L_{12}, L_{13}, \ldots$ of sound paths 12, 13, 14, . . . in an axial direction of the duct body 11 and the lengths $l_{12}, l_{13}, \ldots$ represent the actual lengths of the respective sound paths 12, 13, 14, . . . from their entrance n to their exits m. The sound travelling along one $l_i$ of the lengths $l_{12}, l_{13}, \ldots$ compared with the sound travelling along the length $L_i$ (of the sound path in the axial direction) will have opposite phases and thus cancel each other out at a given frequency $\nu$ where:

$$K\lambda(\pi/2)=l_i-L_i \ldots \quad (1)$$

where $\nu$ equals frequency of a sound wave: $\lambda$ equals wavelength of the sound wave; C equals the speed of sound which is equal to $\lambda\nu$; and k is a desired non-zero constant (preferably an integer) so that the different sound paths will be out of phase with the axial sound path at the exit m by one half wavelength or an odd multiple thereof at a desired frequency $\nu$.

Figure 1:
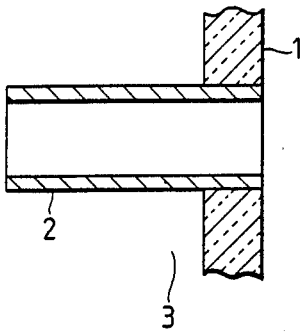
FIG. 1 PRIOR ART
FIG. 1 is a cross sectional view of a prior art duct.
Figure 2:
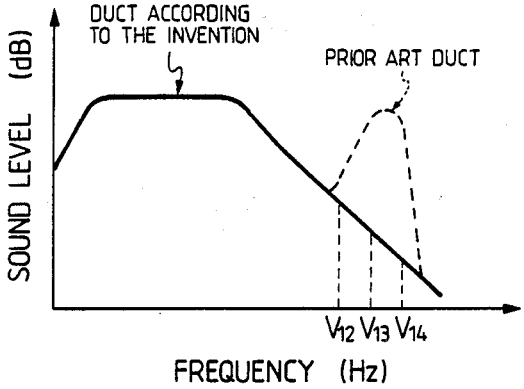
FIG. 2 is a frequency characteristic diagram of sound level at a duct aperture of a duct according to the prior art and a duct according to the invention.

A phase difference is also caused at frequencies of about $\nu/k$ and sound pressure level decreases in a frequency range about the frequency $\nu/k$ due to phase interference. Thus, the lengths of each of the sound paths are properly set according to the above equation to reduce a peak (occurring at the corresponding wavelengths e.g. $\nu_{12}, \nu_{13}, \nu_{14}, \ldots$) shown by a dotted line in FIG. 2, thereby obtaining characteristics shown by a solid line in FIG. 2. For example, the equation would be solved for each of $\nu_{12}, \nu_{13}, \ldots$ until there are sufficient sound paths to remove the peak.

Figure 3:
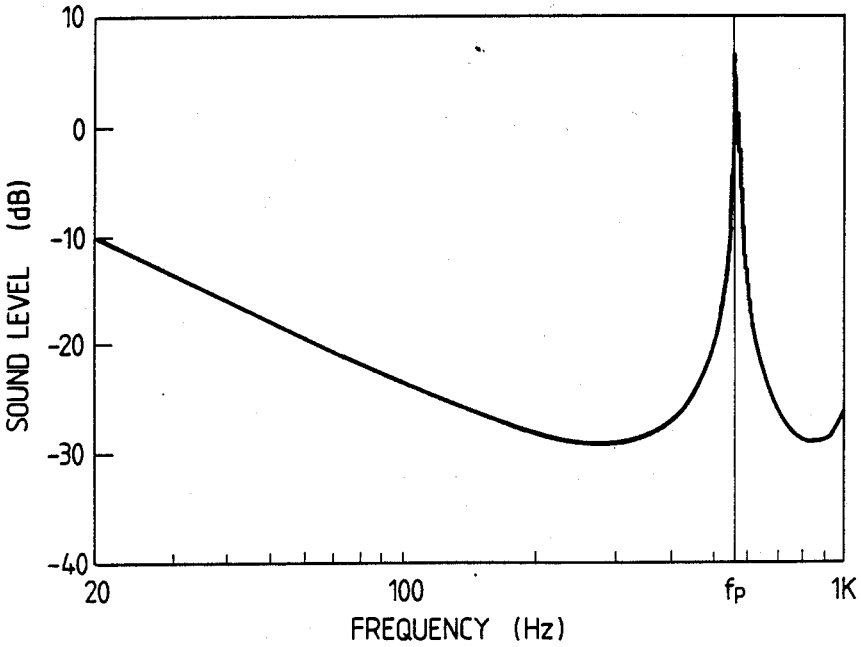
FIG. 3 PRIOR ART
FIG. 3 is a frequency characteristic diagram of sound level at a duct aperture of a duct according to the prior art.

That is, at a particular frequency at which the peak occurs (e.g. see $f_p$ in FIG. 3), the corresponding wavelength is determined based on the equation: $C=\lambda\nu$. Then, this corresponding wavelength is substituted into the above equation (1) to obtain the difference in the lengths of the sound paths i. The value of the constant k is then selected such that it will cause destructive interference between the sound waves at the particular frequency travelling along the path 11 with the sound waves travelling along the path i at the same particular frequency so as to remove the portion of the peak corresponding to that particular frequency, and frequencies proximate to that particular frequency. Depending on the width of the peak in sound level, it may be desirable to select multiple frequencies within the peak at a desired interval or intervals, and multiple sound paths which each satisfy the above-mentioned equation for a particular selected frequency. For example, sound path 12 may be designed to remove a portion of the peak corresponding to the frequency $\nu_{12}$. To remove the rest of the peak, paths 13 and 14 can be formed to correspond to frequencies $\nu_{13}, \nu_{14}$, respectively.

The differences between lengths $l_{12}, l_{13}, \ldots$ and the lengths $L_{12}, L_{13}, \ldots$ correspond to frequencies ($\nu_{12}, \nu_{13}, \ldots$) in the mid frequency range and are not a function of the frequencies in a low frequency range. Thus, the difference in the lengths of each sound path will not disturb the bass reflex operation of the duct 10. At a frequency $\nu/k_1$, where $\lambda l=l\text{-}\lambda$, the sound along the length l and the sound through the sound path of length L will be in-phase to increase sound pressure level. But the frequency is high, expressed by $\nu/k_1=2\nu k$, and the increase in sound pressure level will not effect the quality of sound since the pressure is usually inherently low at such a high frequency due to a LPE (low pass filter) of the woofer in the speaker.

It should be noted that the constant k is preferably selected as an odd integer in order to cause total destructive interference between the sound at a particular frequency passing through the path i with the sound at the particular frequency passing through the paths 11. Further, some destructive interference will occur at frequencies adjacent to the particular frequency. However, even though interference is total at a particular frequency, the sound level at that frequency need not be equal to zero because additional sound paths will carry some sound at that frequency. For example, if sound passing through paths 11 and 12 has total destructive interference at frequency $f_x$, sound at frequency $f_x$ will still pass through path 13 and will not be destructively interferred with due to the different length of path 13.

Figure 7:
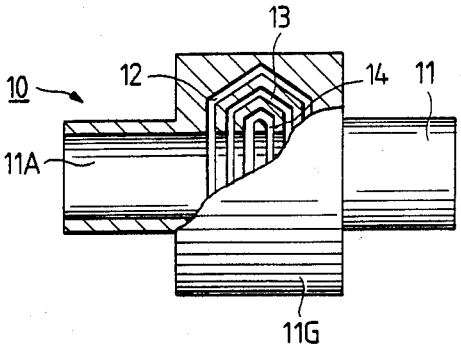
FIG. 7 is a cross sectional view of FIG. 6.

FIG. 7 shows an example of the sound path, where a swelled portion 11G is formed at an intermediate portion of the duct body 11 and a group of sound paths are provided diametically within the swelled portion 11G, with each path in the group being formed like a slit in the portion 11G.

Figure 8:
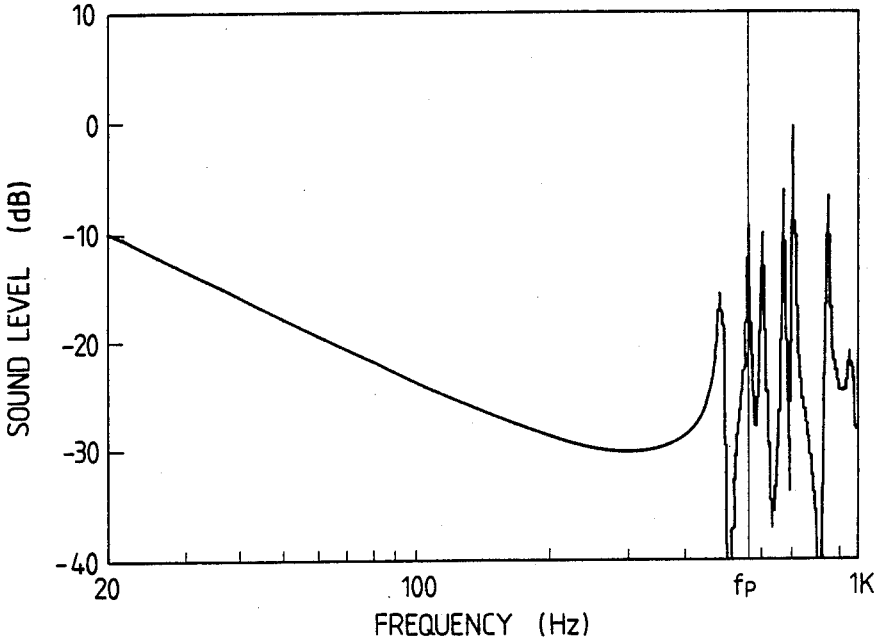
FIG. 8 is a frequency characteristic diagram of sound level at a duct aperture of a duct according to the invention.

FIG. 8 shows a frequency characteristic diagram of sound level at a duct aperture of a bass reflex type speaker system according to the present invention. As can be seen from a comparison of FIGS. 3 and 8, the sound level at the frequency $f_p$ is decreased as shown in FIG. 8. An example of suitable lengths $L_i$ and $l_i$ for a duct system according to the invention is set forth below:

| | |
|---|---|
| $L_{11}$ = 300 mm | |
| $L_{12}$ = 280 mm | $l_{12}$ = 350 mm |
| $L_{13}$ = 240 mm | $l_{13}$ = 300 mm |
| $L_{14}$ = 200 mm | $l_{14}$ = 250 mm |

As apparent from the above description, a bass reflex type speaking system according to the present invention is provided with a plurality of sound paths having sound routes of different lengths for by passing sound. Therefore, leakage of the mid frequency sound components through the duct aperture is reduced without disturbing the bass reflex effect at the low frequency range, thereby improving various acoustic properties and the quality of sound produced by the system.

What is claimed is:

1. A bass reflex type speaker system, comprising:

a speaker cabinet;

a speaker mounted in said cabinet for transmitting sound waves;

a duct mounted in said speaker, said duct being open at opposite ends thereof so as to communicate an interior of said cabinet to an exterior of said cabinet wherein said duct has a plurality of sound paths for transmitting the sound waves through said duct from said interior to said exterior, at least first and second of said sound paths forming junctions at respective ends of said sound paths and having a difference in length such that respective portions of the sound waves travelling through said first and second sound paths destructively interfere at one of said junctions of said first and second paths, wherein the destructive interference occurs at a particular frequency.

2. A bass reflex type speaker system according to claim 1, wherein said difference in length corresponds to one half a wavelength of said sound waves or an odd integer multiple thereof.

3. A bass reflex type speaker system according to claim 2, wherein said wavelength is selected so as to correspond to said particular frequency, and the particular frequency is one at which a local relative peak in sound level occurs.

4. A bass reflex type speaker system according to claim 1, wherein said plurality of sound paths includes a third sound path having a difference in length with respect to said first sound path different from that of the difference in length between said first and second sound paths.

5. A duct for a bass reflex type speaker system in which said duct is open at opposite ends, and sound waves are transmitted through the duct from an interior of said system to an exterior thereof, the duct comprising:

a housing, and a plurality of sound paths formed in said housing for transmitting the sound waves therethrough, at least first and second of said sound paths forming junctions respective ends of said sound paths and having a difference in length such that respective portions of the sound waves traveling through said first and second sound paths destructively interfere at one of said junctions of said first and second paths, wherein the destructive interference of the sound waves occurs at a particular frequency.

* * * * *